US006529137B1

(12) United States Patent
Roe

(10) Patent No.: US 6,529,137 B1
(45) Date of Patent: Mar. 4, 2003

(54) METHOD AND APPARATUS FOR DISPLAYING ALARM INFORMATION

(75) Inventor: William Roe, Stevenswille, MD (US)

(73) Assignee: Compass Technologies, Inc., Exton, PA (US)

( * ) Notice: Subject to any disclaimer, the term of this patent is extended or adjusted under 35 U.S.C. 154(b) by 0 days.

(21) Appl. No.: 09/652,967

(22) Filed: Aug. 31, 2000

Related U.S. Application Data

(60) Provisional application No. 60/152,149, filed on Aug. 31, 1999.

(51) Int. Cl.[7] ..... G08B 3/00; G08B 5/00; G08B 7/00

(52) U.S. Cl. ..... 340/691.1; 340/525; 700/17

(58) Field of Search ..... 340/691.1, 525, 340/517, 521, 691.6; 700/17, 83

(56) References Cited

U.S. PATENT DOCUMENTS

| | | | | | |
|---|---|---|---|---|---|
| 4,853,175 | A | * | 8/1989 | Book, Sr. | 376/216 |
| 5,297,252 | A | * | 3/1994 | Becker | 395/356 |
| 5,428,341 | A | * | 6/1995 | Takahashi | 340/506 |
| 5,859,885 | A | * | 1/1999 | Rusnica et al. | 376/259 |
| 5,956,665 | A | * | 9/1999 | Martinez et al. | 702/188 |
| 5,977,872 | A | * | 11/1999 | Guertin | 340/515 |
| 6,154,129 | A | * | 11/2000 | Kajitani et al. | 340/506 |
| 6,229,429 | B1 | * | 5/2001 | Horon | 340/286.01 |

* cited by examiner

*Primary Examiner*—John Tweel
(74) *Attorney, Agent, or Firm*—Moser, Patterson & Sheridan, LLP.; Kin Wah Tong, Esq.

(57) ABSTRACT

A method and apparatus for processing and displaying "alarm" information. Specifically, four separate windows are simultaneously presented to an operator during an alarm condition, where the four windows present an alarm event, alarm instructions, a map of the location of the alarm event and alarm responses, respectively.

21 Claims, 5 Drawing Sheets

METHOD AND APPARATUS FOR DISPLAYING ALARM INFORMATION

This application claims the benefit of U.S. Provisional Application No. 60/152,149 filed on Aug. 31, 1999, which is herein incorporated by reference.

The present invention relates to a method and apparatus for displaying alarm information. More particularly, this invention relates to a method and apparatus that quickly displays pertinent alarm information within a monitored facility or area.

BACKGROUND OF THE DISCLOSURE

With the ever-increasing proliferation of technology and information, many corporations have manufacturing and engineering facilities that house sensitive and proprietary information and serve as working environments for countless employees. To protect their occupants and valuable assets, many facilities have extensive facility management systems that monitor various conditions associated with security (e.g., entry/exit), safety (e.g., fire and other hazardous events), and general maintenance (e.g., proper environmental controls such as temperature and humidity).

As such facility management systems become more sophisticated and take on an ever increasing number of monitoring functions, the amount of collected information also increases greatly. In fact, as corporations proceed toward computerizing employee information, such large quantity of employee information can be made directly available to the facility management systems. Although linking such information to facility management systems will likely increase their efficiency and effectiveness, such large quantity of information becomes unwieldy.

Specifically, as the complexity and functions of such systems increase, the level of training of the facility monitoring force must also increase accordingly. However, security employment opportunities are traditionally low paying jobs that have been filled by workers having rudimentary or no knowledge of computer systems. Thus, although numerous information and functions may be available in such facility management systems, the unskilled security force may be overwhelmed by the complexity and numerous functions offered in the facility management systems.

Additionally, regardless of the skills of the security force, during an alarm situation, e.g., a fire within the facility, the security force is under great duress to act quickly such that the complexity and the numerous functions offered in the facility management systems may actually become a hindrance instead of an aid. Since such alarm conditions are rare events, even a properly trained security personnel may be overwhelmed to properly diagnose the alarm condition and to perform the proper steps to address such alarm conditions.

Therefore, there is a need in the art for a method and apparatus for quickly and effectively displaying trace information within a monitored facility or area.

SUMMARY OF THE INVENTION

In one embodiment of the present invention, a method and apparatus is disclosed that displays alarm event and pertinent information in a unique screen structure. Specifically, the alarm display screen is designed in such a way as to provide an operator or security officer with all pertinent alarm data in an efficient and orderly manner. This unique representation of alarm data leads an operator through a logical sequence of steps for proper alarm management.

Specifically, all data necessary for proper alarm management is presented to the operator simultaneously, without creating undo "screen clutter". In addition, the number of computer keystrokes normally required by an operator to properly respond to an alarm is kept to a minimum. This unique combination results in fast and efficient alarm processing.

In operation, the alarm display is divided into 4 quadrants, with each quad containing separate, but relative information. For example, quadrant 1 (e.g., upper left on the screen)—displays all active alarms with priority level, received date, and received time. Each alarm entry is color coded by status (acknowledged, reset, etc). Quadrant 2 (e.g., upper right on the screen) displays alarm instructions in dealing with the alarm event. Quadrant 3 (e.g., lower left on the screen) displays a map showing the exact alarm location. Quadrant 4 (e.g., lower right on the screen) displays pre-defined, user programmable alarm responses, e.g., a check list of responses that must be made by the operator.

This unique display of an alarm event in a clear and efficient manner greatly reduces the stress placed on the operator. The simultaneous display of all the relevant information allows the operator to properly handle the alarm event in the most efficient and safe manner.

BRIEF DESCRIPTION OF THE DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

Figure 1:
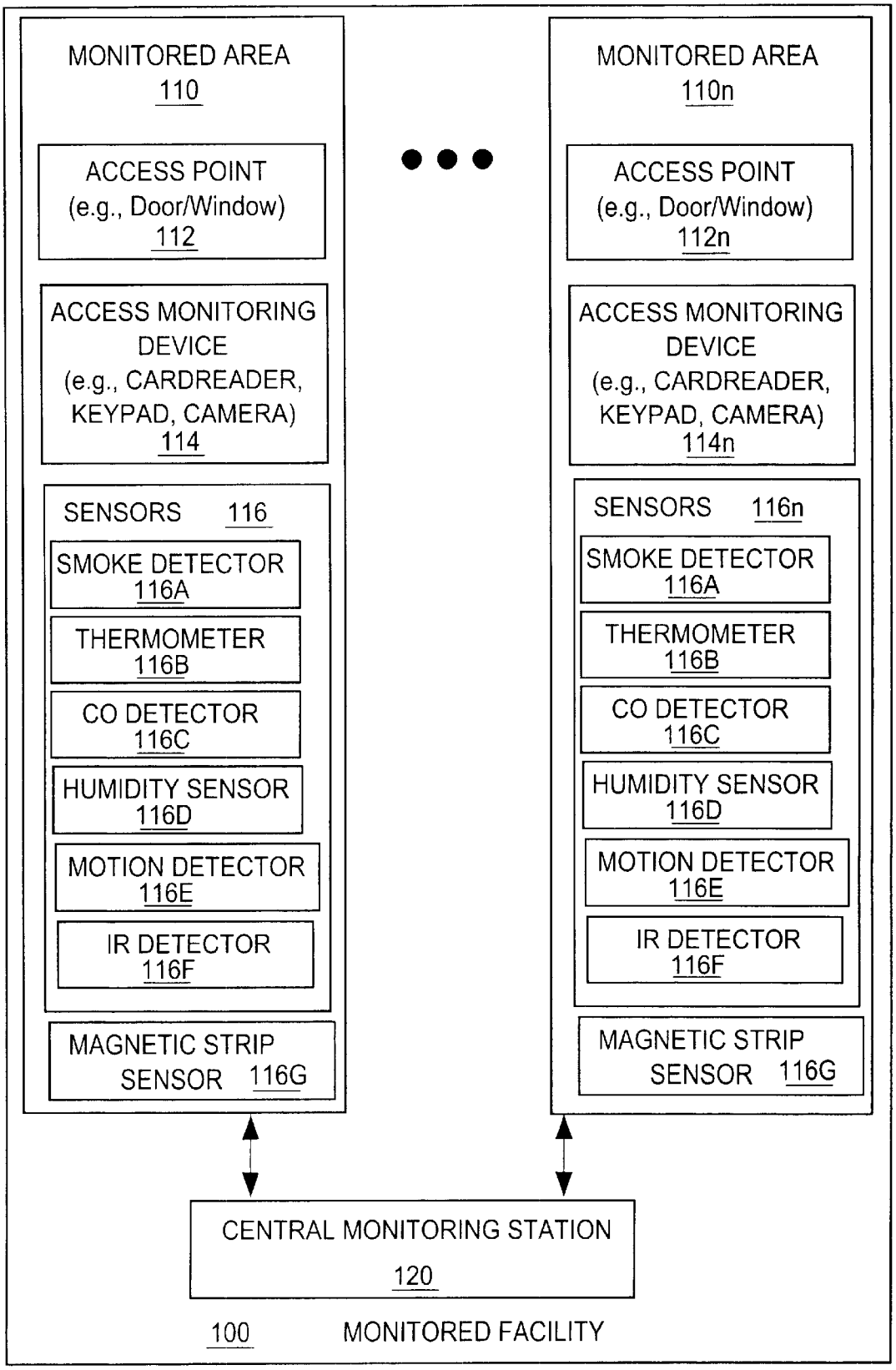
FIG. 1 depicts a block diagram of a monitored facility with the present invention.

FIG. 1 depicts a block diagram of a monitored facility 100 with the present invention. The monitored facility 100 comprises one or more monitored areas **110–110*n* and a central monitoring station or system 120**.

In operation, each monitored area 110 comprises a physical access point 112, e.g., a door, a window, or a predefined demarcation or boundary within the monitored facility. Associated with each physical access point 112 is an access control or monitoring device 114, e.g., a card reader, a keypad, a fingerprint reader, a scanner, and the like. Depending on the application, the access control or monitoring device 114 may or may not control access through the access point. For example, a proper reading at the card reader 114 may physically unlock the door 112. Alternatively, the card reader 114 may simply record an activity event such as recording the passage of a user at the access point at a particular date and time.

Additionally, one or more sensors 116 can be optionally deployed as necessary for a particular application in a monitored facility. For example, the sensors 116 may include but are limited to a smoke detector 116*a,* a thermometer 116*b,* a carbon monoxide (CO) detector 116*c,* a humidity sensor 116*d,* a motion detector 116*e,* an infrared (IF) detector 116*f,* a magnetic strip sensor 116*g* and the like. In one embodiment of the present invention, the central monitoring station or system is deployed at a security check point within the facility, where the security check point is manned by a security officer. The central monitoring station or system 120 is equipped with a software application that is capable of quickly providing "alarm" information to the security officer via a display. Specifically, the "alarm" information provides the security officer with the alarm type (e.g., a fire, an illegal entry or exit, an abnormal environmental condition and the like), alarm instructions to handle the alarm event, a picture of the location of the alarm event and alarm responses that are appropriate to the alarm event, e.g., a check list in the proper executional order. The layout of the alarm information (i.e., screen display) is disclosed below.

Figure 2:
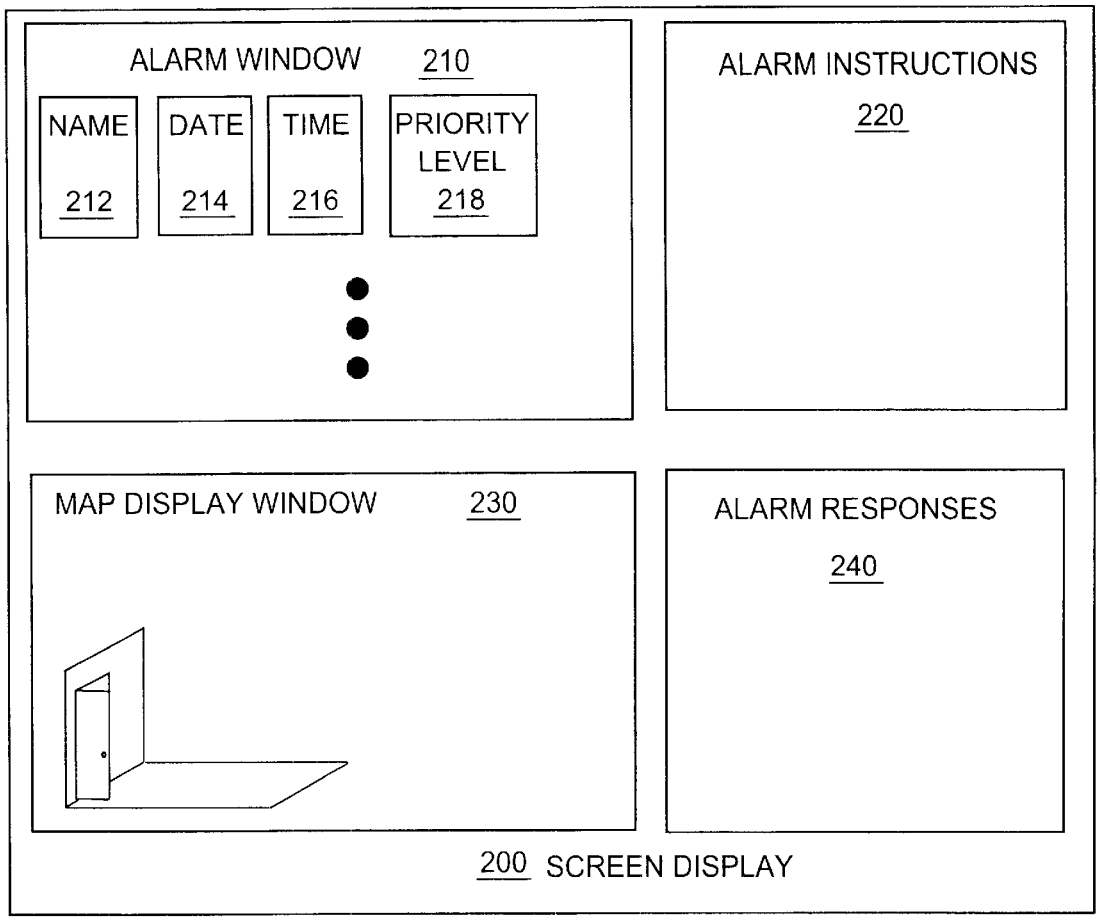
FIG. 2 depicts a block diagram of a screen display of the present invention.

FIG. 2 depicts a block diagram of a screen display 200 at a central monitoring station of the present invention. The screen display 200 illustrates the alarm information in four (4) distinct windows: 1) alarm window 210, 2) alarm instruction window 220, 3) map display window 230 and 4) alarm response window 240.

In operation, the alarm window 210 receives updates from various access monitoring devices 110 or sensors 116 that are deployed throughout the monitored facility. The alarm window will display each instance of an alarm event. Each alarm record may contain a name field 212 ((i.e., a user-defined field that may identify the alarm type), the priority level 218 of the alarm event (e.g., a user-defined field that may assign high priority for fire and criminal activities and low for abnormal environmental conditions), the date 214, and the time 216. The records in the alarm window are stored in a software file named "alarm file".

The alarm instruction window 220 provides a list of instructions to be taken by the operator associated with the detected alarm event. In operation, if a fire is detected at the alarm window 210, the alarm instruction window 220 will provide a list of instructions to handle the fire, e.g., 1) describe the location of alarm button that will sound fire alarm to evaluate the facility, 2) provide instructions on how to confirm existence of a fire condition, e.g., the phone number of the nearest security officer or which video camera to maneuver to view the alarm location, 3) provide instruction on contacting local fire department, e.g., a phone number, 4) provide instructions on how to activate fire suppression system, 5) provide instructions on how to evacuate facility and so on. The automatic display of this information will immediately provide the operator with a list of appropriate actions that must be taken in a preferred executional order. This independent operation allows the operator to immediately act instead of contemplating what the appropriate actions should be or to attempt to retrieve other information.

Simultaneously, the map display window 230 provides a digitized image or graphic image of the location of the alarm event. In operation, as the alarm window detects an alarm event, the relevant information is passed to the map display window 230 which independently retrieves the facility image for display. Again, this independent operation allows the alarm window to immediately return to its monitoring function to detect the next alarm event without being slowed down in retrieving other information.

Figure 5:
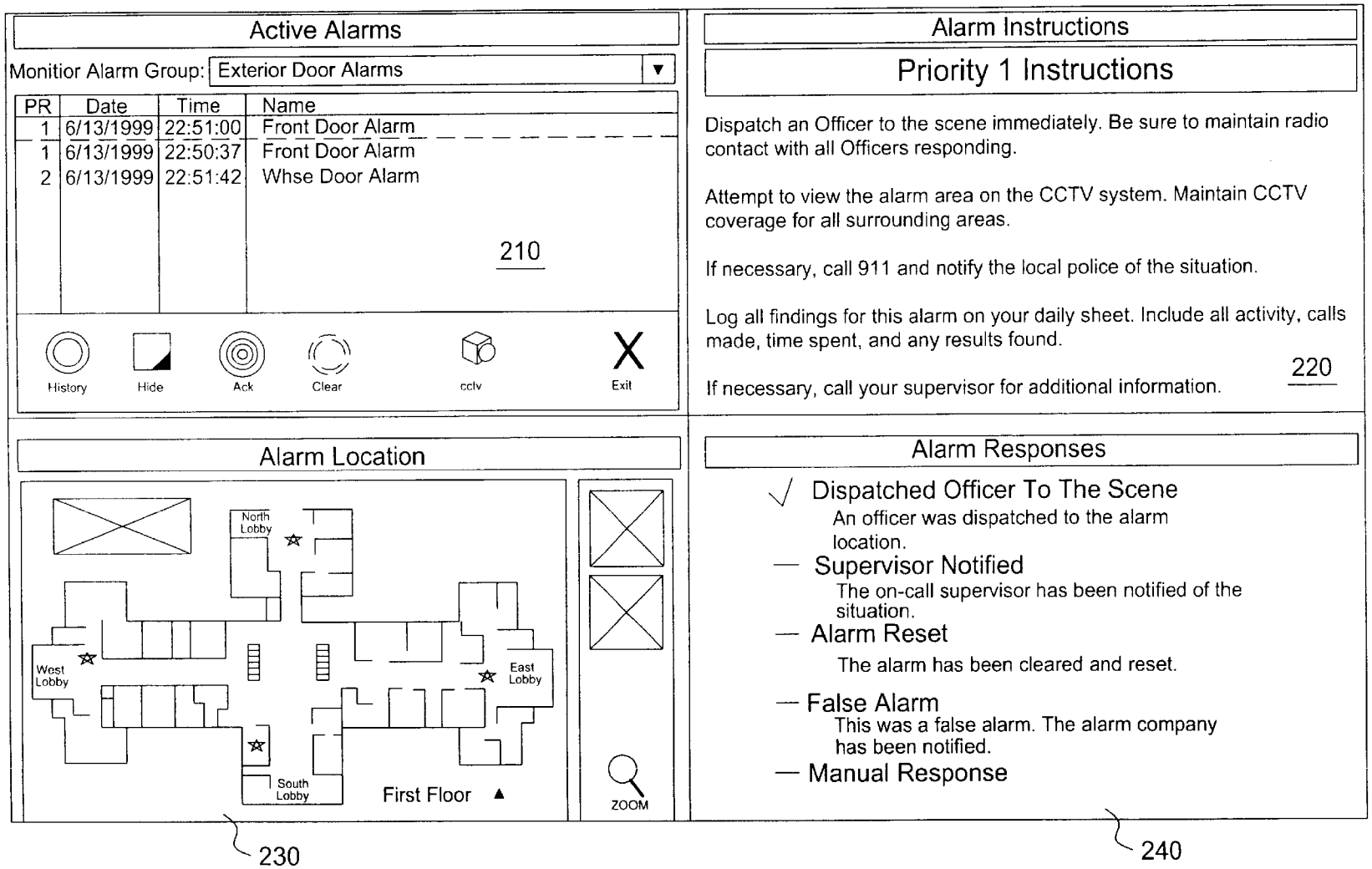
FIG. 5 illustrates an actual computer screen display of the present invention.

More specifically, in one embodiment a first thread or main thread is dedicated to the processing and detection of alarm events. Once the first thread detects and logs an alarm event with the central monitoring station, the first thread will store the detected alarm event into a file and may generate messages to other threads, e.g., a second, third or fourth threads. Each thread is dedicated to the processing of specific information, thereby allowing each process to operate independently from other processes. For example, each of the four windows in FIGS. 2 and 5 can be implemented using separate threads. Alternatively, the number of threads can be reduced by only implementing separate threads for computationally intensive functions, e.g., the retrieval of graphics such as in map display window 230.

One advantage of the present invention is the ability to quickly display multiple sets of information simultaneously. A security guard monitoring the central monitoring station will observe the occurrence of alarm events, while the software will simultaneously retrieve the necessary information to assist the security guard in dealing with the alarm events.

Finally, the alarm response window provides a list of proper responses that must be performed. In one embodiment, the alarm responses are provided as a check list. Namely, under a stressful situation, the operator may receive all the alarm instructions but only actually perform a subset of the actions dictated by the alarm instructions. The alarm response window serves as a checklist that must be complied with in order for the alarm to clear. Using the fire event again as an example, the alarm response window may have a checklist of:

Activate fire alarm

Visually confirm fire

Call fire department

Activate sprinkler system

Evacuate personnel from facility

The software can be programmed to designate "action buttons" for alarm processing, e.g., "soft" buttons that can be "clicked" by manipulation of a mouse. The selected buttons cause a change in the display such that (e.g., a rectangle changes into a check mark). The operator may track what actions need to be done and what actions have already been done. An actual computer screen display 500 of the present invention is provided in FIG. 5.

Figure 3:
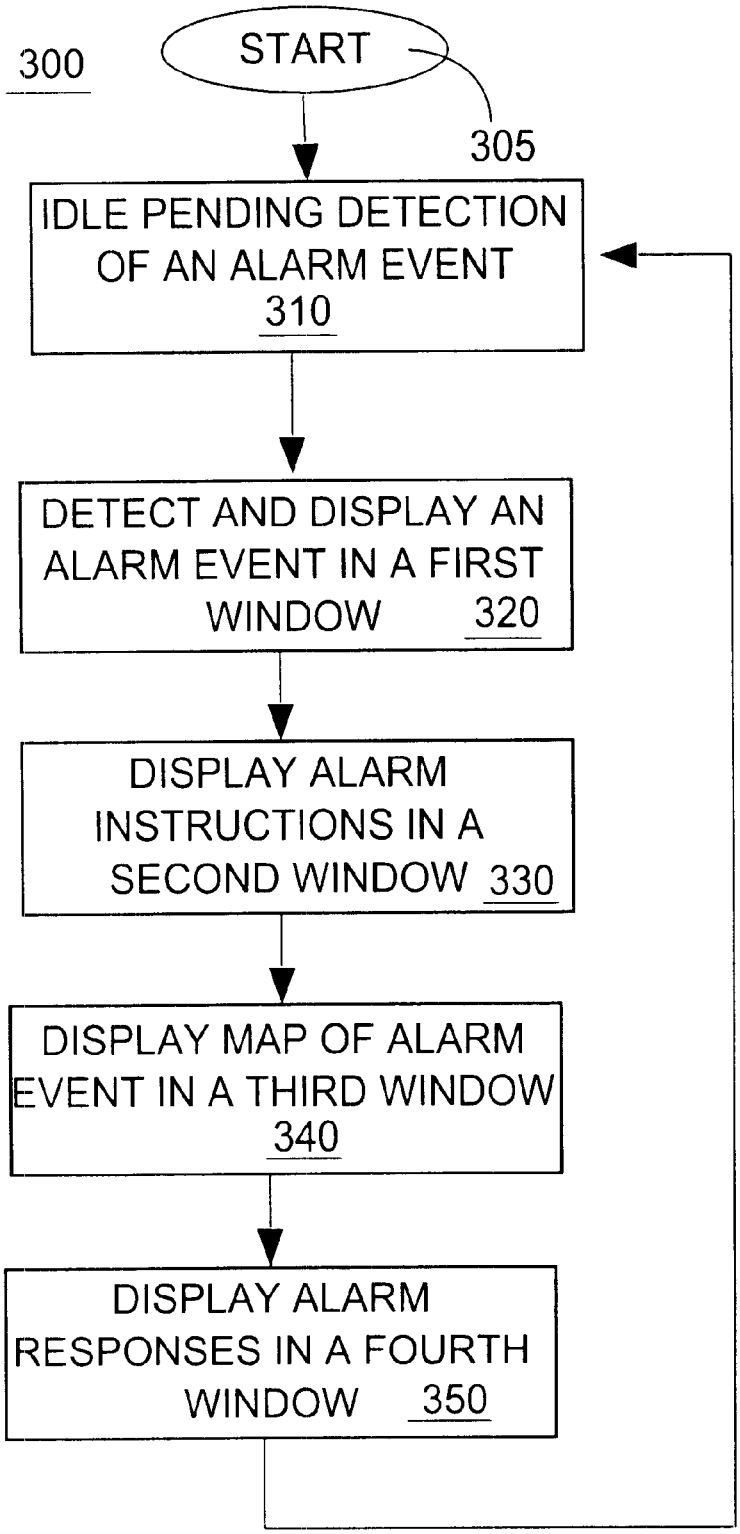
FIG. 3 depicts a block diagram of a flowchart of the method of the present invention.

FIG. 3 depicts a block diagram of a flowchart of a method 300 for retrieving and displaying alarm information of the present invention. The method starts in step 305 and proceeds to step 310 where the method is idle or is in a wait state pending detection of an alarm event. Specifically, method 300 is waiting for an interrupt from the various access monitoring devices 114 or sensors 116 to report an alarm event. Alternatively, method 300 may periodically poll each of these devices.

In step 320, an alarm event is detected and reported to the central monitoring station 120 via a record entry into the alarm window 210. Alarm events include but are not limited to a fire, an illegal entry or exit, an abnormal environmental condition and the like. Once the alarm event is detected and logged with the central monitoring station, method 300 proceeds to step 330.

In step 330, method 300 displays the alarm instructions associated with the detected alarm events or conditions. The instructions are programmable in view of a particular application.

In step 340, method 300 extracts the necessary information, e.g., the sensor number to retrieve the relevant facility information from a storage server, e.g., the image of the location where the alarm event has been detected. The image can be a digitized image or a graphical image.

In step 350, method 300 displays the alarm responses associated with the detected alarm events or conditions. The alarm responses are programmable in view of a particular application and are presented in a checklist format. Method 300 then returns to step 310.

One important advantage of the present invention is the ability to quickly and efficiently presents four sets of alarm information simultaneously. A security guard monitoring the central monitoring station will observe the occurrence of an alarm event, while the software simultaneously retrieves additional information to assist the security guard in dealing with the alarm event. The present invention serves to minimize the duress experienced by the security force in responding to alarm events that may not be routine. The proper display of the relevant information may be a key component in properly handling the alarm event, thereby saving lives and preserving valuable properties.

Figure 4:
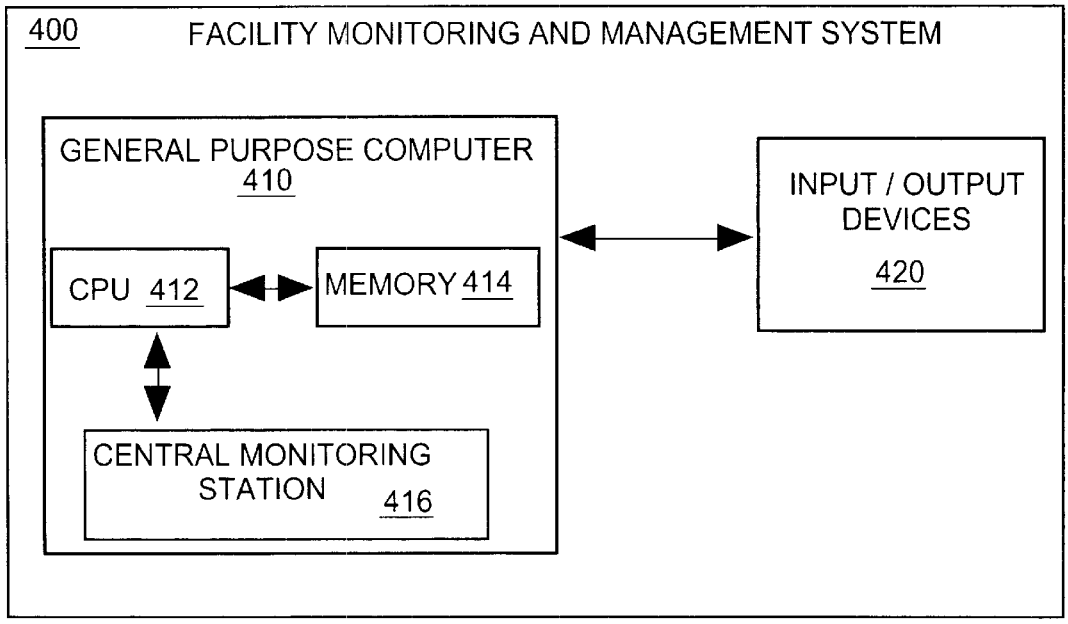
FIG. 4 illustrates a block diagram of the monitoring system of the present invention.

FIG. 4 illustrates a block diagram of a facility monitoring and management system 400 of the present invention. The facility monitoring and management system comprises a general purpose computer 410 and various input/output devices 420. The general purpose computer comprises a central processing unit (CPU) 412, a memory 414 and a central monitoring station 416 for quickly and effectively displaying trace information within a monitored facility or area.

In the preferred embodiment, the central monitoring station 416 is the central monitoring station 120 as discussed above. The central monitoring station 416 can be a physical device, which is coupled to the CPU 412 through a communication channel. Alternatively, the central monitoring station 416 can be represented (in part or in whole) by a software application that is loaded from a storage device and resides in the memory 414 of the computer. As such, the central monitoring station 416 and associated methods and/or data structures of the present invention can be stored on a computer readable medium.

The computer 410 can be coupled to a plurality of input and output devices 420, such as a keyboard, a mouse, a camera, a camcorder, a video monitor, any number of imaging devices or storage devices, including but not limited to, a tape drive, a floppy drive, a hard disk drive or a compact disk drive.

Although various embodiments which incorporate the teachings of the present invention have been shown and described in detail herein, those skilled in the art can readily devise many other varied embodiments that still incorporate these teachings.

What is claimed is:

1. Method for displaying alarm information within a monitored area, said method comprising the steps of:

(a) displaying an alarm event in a first window;

(b) displaying an alarm instruction in a second window;

(c) displaying an image of a location of said alarm event in a third window; and (d) displaying an alarm response in a fourth window, wherein said alarm response represents a summary of said alarm instruction that must be taken to address. said alarm event, wherein said four windows are all displayed on a single screen.

2. The method of claim 1, wherein said displaying steps (a), (b), (c) and (d) are implemented using a plurality of threads.

3. The method of claim 2, wherein said displaying step (c) is implemented using a separate thread from said plurality of threads.

4. The method of claim 1, wherein said displaying step (a) displays a name field that describes an alarm type.

5. The method of claim 1, wherein said displaying step (a) displays an alarm event that describes a priority level.

6. The method of claim 1, wherein said displaying step (a) displays an alarm event that describes a date of said alarm event.

7. The method of claim 1, wherein said displaying step (a) displays an alarm event that describes a time of said alarm event.

8. The method of claim 1, wherein said displaying step (c) displays an actual digitized image of said location of said alarm event.

9. The method of claim 1, wherein said displaying step (c) displays a graphical image of said location of said alarm event.

10. A screen display comprises:

an alarm window for indicating an alarm event;

an alarm instructions window for indicating an alarm instruction;

a map display window for indicating a location of said alarm event; and an alarm responses window for indicating a summary of said alarm instruction that must be taken to address said alarm event.

11. The screen display of claim 10, wherein said alarm window comprises:

a name field for identifying an alarm type;

a time field for indicating a time when said alarm event occurred;

a date field for indicating a date on which said alarm event occurred; and a priority level field for indicating a priority for said alarm event.

12. The screen display of claim 10, wherein said alarm responses window comprises:

selectable buttons for identifying tasks to be completed.

13. A computer-readable medium having stored thereon a plurality of instructions, the plurality of instructions including instructions which, when executed by a processor, cause the processor to perform the steps comprising of:

(a) displaying an alarm event in a first window;

(b) displaying an alarm instruction in a second window;

(c) displaying an image of a location of said alarm event in a third window; and (d) displaying an alarm response in a fourth window, wherein said alarm response represents a summary of said alarm instruction that must be taken to address said alarm event, wherein said four windows are all displayed on a single screen.

14. The computer-readable medium of claim 13, wherein said displaying steps (a), (b), (c) and (d) are implemented using a plurality of threads.

15. The computer-readable medium of claim 14, wherein said displaying step (c) is implemented using a separate thread from said plurality of threads.

16. The computer-readable medium of claim 13, wherein said displaying step (a) displays a name field that describes an alarm type.

17. The computer-readable medium of claim 13, wherein said displaying step (a) displays an alarm event that describes a priority level.

18. The computer-readable medium of claim 13, wherein said displaying step (a) displays an alarm event that describes a date of said alarm event.

19. The computer-readable medium of claim 13, wherein said displaying step (a) displays an alarm event that describes a time of said alarm event.

20. The computer-readable medium of claim 13, wherein said displaying step (c) displays an actual digitized image of said location of said alarm event.

21. The computer-readable medium of claim 13, wherein said displaying step (c) displays a graphical image of said location of said alarm event.

* * * * *